United States Patent [19]

Uesawa et al.

[11] Patent Number: 4,891,309

[45] Date of Patent: Jan. 2, 1990

[54] PROCESS FOR PRODUCING SILVER HALIDE PHOTOGRAPHIC PAPER

[75] Inventors: Yutaka Uesawa; Akira Kobayashi; Isamu Morimoto, all of Hino, Japan

[73] Assignee: Konica Corporation, Tokyo, Japan

[21] Appl. No.: 201,889

[22] Filed: Jun. 3, 1988

[30] Foreign Application Priority Data

Jun. 4, 1987 [JP] Japan ..... 62-141200
Jul. 21, 1987 [JP] Japan ..... 62-182946

[51] Int. Cl.[4] ..... G03C 5/16; G03C 1/02; G03C 7/26

[52] U.S. Cl. ..... 430/627; 430/372; 430/377; 430/379; 430/933

[58] Field of Search ..... 430/627, 546, 372, 377, 430/379, 933

[56] References Cited

U.S. PATENT DOCUMENTS 3,295,975 1/1967 Meckl et al. ..... 430/379
4,367,272 1/1983 Hayashi et al. ..... 430/372
4,592,991 6/1986 Yoshida et al. .

FOREIGN PATENT DOCUMENTS 2391490 5/1978 France .
1001702 10/1961 United Kingdom .
1603884 5/1977 United Kingdom .

OTHER PUBLICATIONS

Research Disclosure, No. 195, pp. 301–310, No. 19551, Havant Hampshire, Photographic applications of latices, Jul. 1980.

*Primary Examiner*—Paul R. Michl
*Assistant Examiner*—Thorl Chea
*Attorney, Agent, or Firm*—Finnegan, Henderson, Farabow, Garrett and Dunner

[57] ABSTRACT

A process for producing a silver halide photographic paper that has on a support at least one photographic constituent layer incorporating a silver halide developing agent and at least one photographic constituent layer containing both a polymer latex and an emulsified dispersion of an oil-soluble fluorescent brightener dissolved in a high-boiling point organic solvent wherein said emulsified dispersion is preliminarily mixed with said polymer latex, the resulting mixture then being incorporated in a selected photographic constituent layer.

17 Claims, No Drawings

PROCESS FOR PRODUCING SILVER HALIDE PHOTOGRAPHIC PAPER

BACKGROUND OF THE INVENTION

The present invention relates to a process for producing a silver halide photographic paper incorporating a silver halide developing agent. More particularly, the present invention relates to a process for producing a photographic paper that has improved photographic performance in such aspects as speed and contrast, as well as high pressure resistance, good developability and long keeping quality and which ensures a high degree of whiteness even if it is processed under rapid conditions.

Techniques for achieving good developability have hitherto been proposed such as use of a halide converted emulsion as described in Japanese patent application (OPI) No. 3339/1971 (the term OPI as used hereinafter means an unexamined published Japanese patent application). However, under very rapid processing conditions such as to complete the development within 30 seconds, good developability cannot be achieved to a full extent.

With a view to achieving good developability under very rapid processing conditions, it has been practiced widely to incorporate, in light-sensitive materials, black-and-white developing agents such as hydroquinones, Metol and Phenidone, or color developing agents such as p-phenylenediamine derivatives.

The use of fluorescent brighteners is a well known technique for increasing the whiteness of silver halide photographic paper after processing. For attaining this purpose, oil-soluble brighteners are superior to water-soluble brighteners since they will not be easily lost from the light-sensitive material during processing. Techniques for incorporating oil-soluble brighteners in light-sensitive materials are described in BP No. 1,072,915, Japanese patent publication No. 37376/1970 and Japanese patent application (OPI) No. 134232/1985 (the term OPI as used hereinafter means an unexamined published Japanese patent application), etc. Basically, the methods disclosed in these patents consist of first dissolving oil-soluble brighteners in organic solvents, then forming emulsified dispersions from the solutions, and incorporating them in light-sensitive materials. Japanese patent application (OPI) No. 134232/1985 specifically mentions reduced brightening effects as a problem that is caused by the coexistence of an oil-soluble brightener and a developing agent in the same light-sensitive material, and it proposes a method for solving this problem. Another problem that occurs when both an oil-soluble brightener and a developing agent are present in the same light-sensitive material is that the intensity of fluorescence decreases as the light-sensitive material is stored for a prolonged time. This time-dependent deterioration of fluorescence intensity is of such a great degree as has never been observed with light-sensitive materials that do not contain incorporated developing agents.

In recent years, the demand for improving the photographic performance of light-sensitive materials in such aspects as speed and contrast is constantly increasing. However, the improvement in speed is not preferable from the viewpoint of pressure resistance, particularly in the case of silver halide photographic materials using a high-sensitive silver iodobromide emulsion.

As pressures (mechanical stress) to photographic materials, friction to be caused by feeding frames at the time of taking pictures as in the case of conventional photographic films, folding which occures in large-sized photographic sheets at the time of handling as in the case of printing and X-ray photographic materials, and the like are called in question. Among the problems arising from the above-mentioned pressures, "pressure marks" are particularly problematical as the quality of images obtained from the photographic materials is strikingly damaged.

One method of improving the pressure resistance is disclosed in Japanese patent application (OPI) No. 147727/1985, in which a multi-layer type emulsion containing grains having some layers which are different in iodo content or grains having inner layers of high iodo content is used. However, the effect in respect of pressure resistance is not sufficient.

Another method of improving the pressure resistance is disclosed in Japanese patent applications (OPI) Nos. 122641/1985, 3339/1971 etc., in which good pressure resistance is obtained by using an emulsion prepared by halide conversion. However, the photographic materials produced by this method tend to cause the lowering of contrast particularly at the high density side, and, therefore, is not satisfactory at all in photographic performance.

Still another method of improving the pressure resistance is disclosed in Japanese patent applications (OPI) Nos. 51733/1981, 147142/1981, etc., in which irridium salts are contained in the silver halide grains to improve the pressure resitance. However, the photographic materials produced by this method are insufficient in pressure resistance and, also, inferior in keeping quality.

Still another method of improving the pressure resistance is disclosed in Japanese patent publications Nos. 5017/1974, 28086/1978, etc., in which, as means to improve the pressure resistance from the point of physical properties, a plasticizer such as polymer is added to the silver halide emulsion layer to relax the pressure. However, this method is not effective for all the mechanical stresses in that the plasticizer per se causes deterioration in film strength and, therefore, is limited in the amount to be used and that the photographic materials produced by the method become worse in pressure marks such as abrasion caused by friction with a very hard thing.

SUMMARY OF THE INVENTION

An object, therefore, of the present invention is to provide a process for producing a silver halide photographic paper that is amendable to rapid processing without sacrificing the degree of whiteness.

Another object of the present invention is to provide a process for producing a silver halide photographic paper that experiences a small degree of deterioration in whiteness with time.

A further object of the present invention is to provide a process for producing a silver halide photographic paper that has improved photographic performance in such aspects as speed and contrast, as well as high pressure resistance, good developability and long keeping quality.

Generally, the present invention is directed to a process for producing a silver halide photographic paper that has on a support at least one photographic constituent layer incorporating a silver halide developing agent and at least one photographic constituent layer containing both a polymer latex and an emulsified dispersion of an oil-soluble fluorescent brightener dissolved in a high-boiling point organic solvent. The aforementioned objects of the present invention can be attained by preliminarily mixing the emulsified dispersion and the polymer latex and incorporating the resulting mixture in a selected photographic constituent layer.

DETAILED DESCRIPTION OF THE INVENTION

An emulsified dispersion of an oil-soluble brightener dissolved in a high-boiling point organic solvent can advantageously be prepared by the same methods as those employed to prepare dispersions of conventional oil-soluble couplers or uv absorbers. Stated more specifically, an oil-soluble brightener is dissolved in a high-boiling point organic solvent, optionally together with a low-boiling point organic solvent, and the resulting solution is mixed with an aqueous gelatin solution containing a surfactant, followed by treatment with a suitable emulsifier such as a colloid mill, a homogenizer or an ultrasonic disperser so as to form an emulsified dispersion from the mixture. High-boiling point organic solvents that can be used include carboxylic acid esters, phosphoric acid esters, carboxylic acid amides, and hydrocarbons. Specific examples of the high-boiling point organic solvents that can be used in the present invention with advantage are listed below:

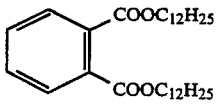

I-1

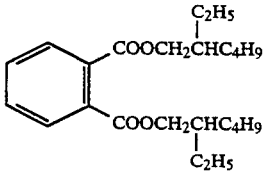

I-2

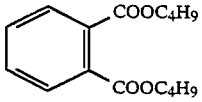

I-3

-continued

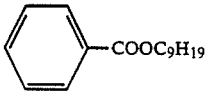

I-4

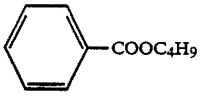

I-5

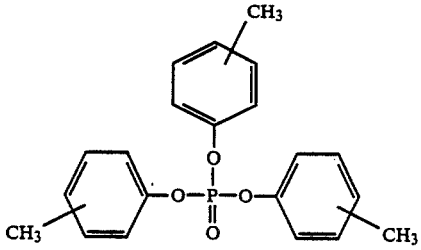

I-6

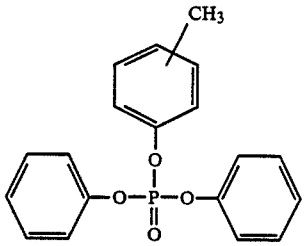

I-7

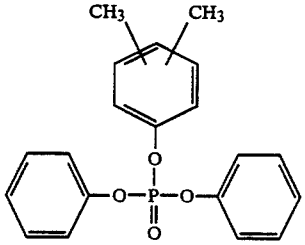

I-8

Paraffin I-9
Paraffin chlorinated I-10

In the present invention, oil-soluble brighteners represented by the following general formulas (II-1), (II-b), (II-c) and (II-d) are advantageously used:

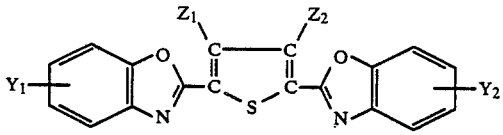

[II-a]

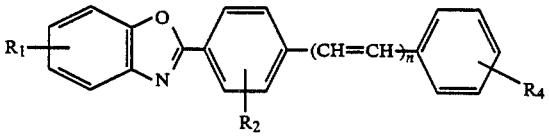

[II-b]

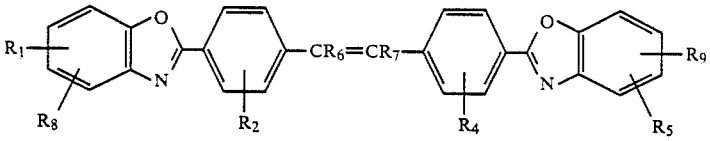

[II-c]

-continued

[II-d]

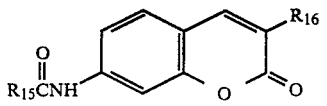

where $Y_1$ and $Y_2$ are each an alkyl group; $Z_1$ and $Z_2$ are each a hydrogen atom or an alkyl group; n is 1 or 2; $R_1$, $R_2$, $R_4$, $R_5$, $R_8$ and $R_9$ are each an aryl, alkyl, alkoxy, aryloxy, hydroxyl, amino, cyano, carboxyl, amido, ester, alkylcarbonyl, alkylsulfo or dialkylsulfonyl group or a hydrogen atom; $R_6$ and $R_7$ are each a hydrogen atom, an alkyl group such as methyl or ethyl, or a cyano group; $R_{16}$ is a phenyl group, a halogen atom, or an alkyl-substituted phenyl group; and $R_{15}$ is an amino group or an organic primary or secondary amine.

Specific examples of the oil-soluble brighteners that can be used in the present invention are listed below under (II-1)–(II-26). Needless to say, the present invention is by no means limited to these specific compounds:

II-1

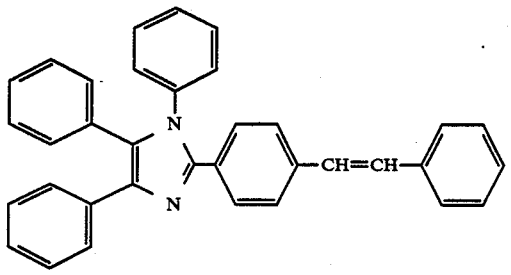

II-2

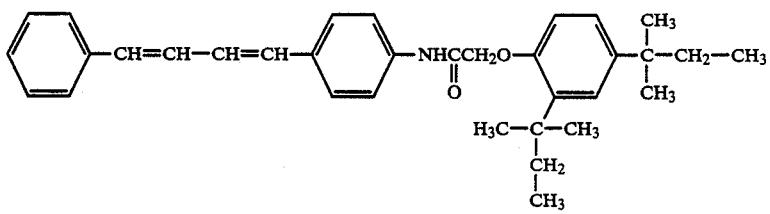

II-3

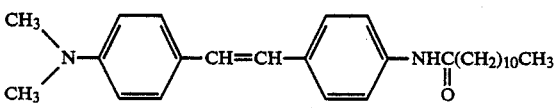

II-4

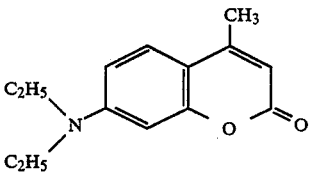

II-5

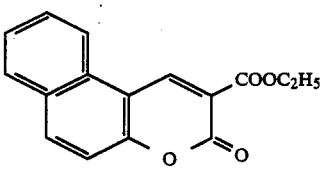

II-6

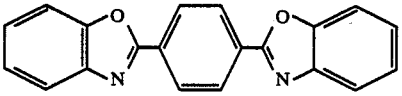

II-7

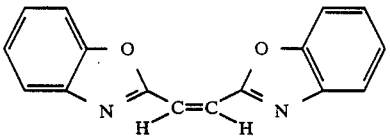

-continued
II-8
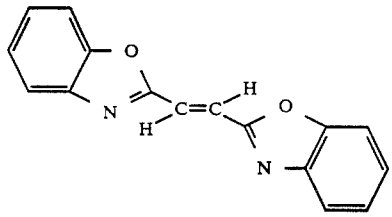
II-9
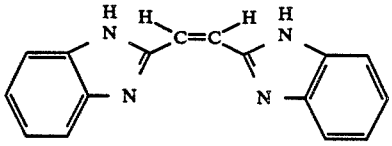
II-10
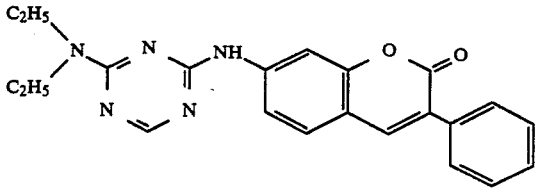
II-11
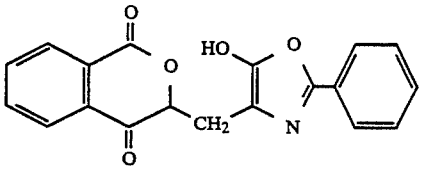
II-12
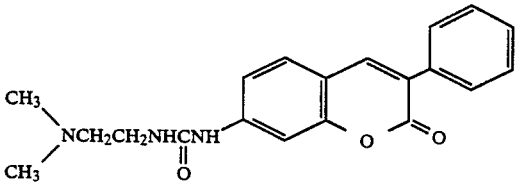
II-13
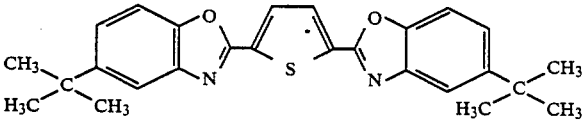
II-14
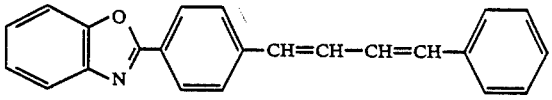
II-15
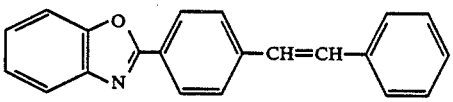
II-16
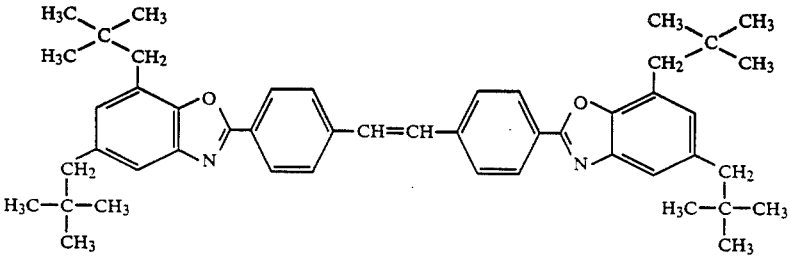

-continued

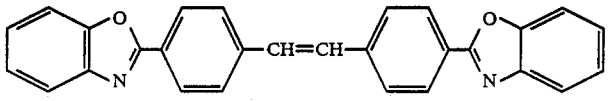

II-17

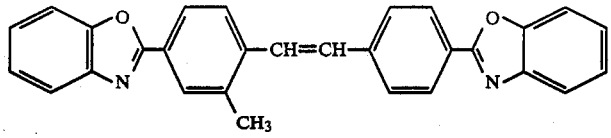

II-18

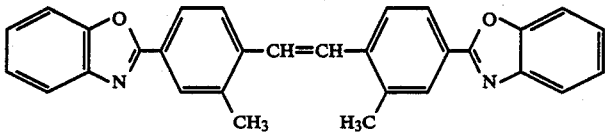

II-19

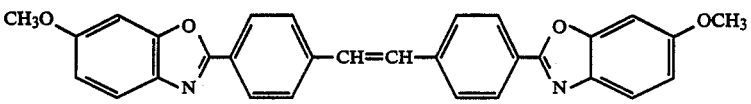

II-20

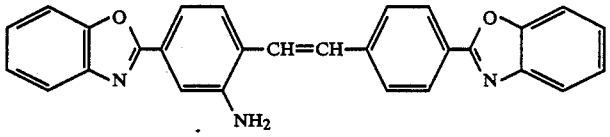

II-21

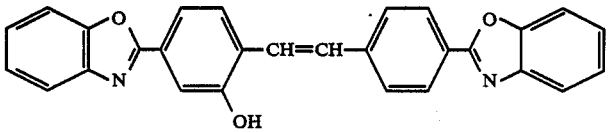

II-22

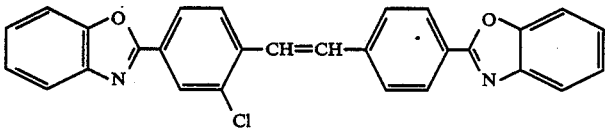

II-23

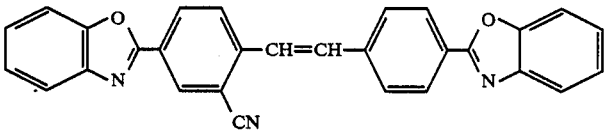

II-24

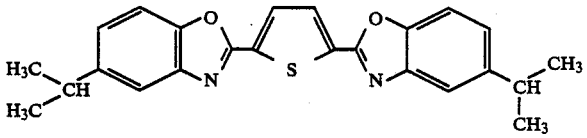

II-25

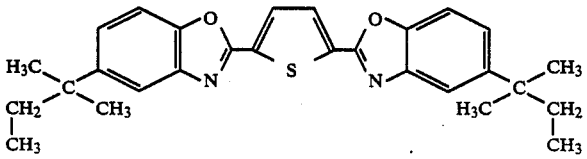

II-26

The above-listed compounds (II- 1) to (II - 26) may be used either on their own or as admixtures. These brighteners are preferably used such that they are present in amounts of 1–200 mg/m$^2$ in photographic paper as the final product, with the range of 5–50 mg/m$^2$ being most preferred.

Emulsified dispersions of brighteners may be incorporated in any of the photographic constituent layers on a support. For anti-blooming purposes, they are preferably incorporated in silver halide emulsion layers or hydrophilic colloidal layers disposed between such emulsion layers and the support.

The polymer latex to be used in the present invention is desirably a homo- or co-polymer that has at least one alkyl acrylate unit in its building block. Specific examples of the alkyl acrylate that are used in preparing the polymer latex include methyl acrylate, ethyl acrylate, propyl acrylate, butyl acrylate, amyl acrylate and hexyl acrylate. An ethylenically unsaturated monomer other than the alkyl acrylate may also be used as a building block of the copolymer. Specific examples include: unsaturated carboxylic acids such as acrylic acid, itaconic acid and methacrylic acid; α-substituted alkyl acrylates such as methyl methacrylate and butyl methacrylate; acrylamides such as butyl acrylamide; α-substituted acrylamides such as butyl methacrylamide; vinyl esters such as vinyl acetate; vinyl halides such as vinyl chloride and vinylidene chloride; styrene; α-substituted styrenes such as α-methylstyrene; and ethylene, propylene, butylene and butadiene.

The polymer latex can be prepared by emulsion polymerization. Suitable emulsifiers are anionic surfactants such as sodium salts of higher alkyl sulfate esters, sodium higher alkylbenzene-sulfonates, alkylphenyl polyethylene glycols, sodium salts of sulfate esters, sodium salts of alkyl polyethylene glycol ether sulfate esters, and sulfosuccinate esters. Other surfactants such as nonionics, cationics and amphoterics are also usable as emulsifiers.

Specific methods for preparing the polymer latex are described in Japanese patent publication Nos. 18415/1970 and 20532/1974.

Specific examples of the polymer latex that can be used in the present invention are listed below under (III-1) to (III-10). Needless to say, the present invention is by no means limited to these examples:

(III-1) Homopolymer of ethyl acrylate;
(III-2) Homopolymer of butyl acrylate;
(III-3) Copolymer of ethyl acrylate and acrylic acid;
(III-4) Copolymer of butyl acrylate and acrylic acid;
(III-5) Copolymer of butyl acrylate and vinyl acetate;
(III-6) Copolymer of ethyl acrylate and sulfopropyl acrylate;
(III-7) Copolymer of butyl acrylate and sulfopropyl acrylate;
(III-8) Copolymer of ethyl acrylate, acrylic acid and 2-acetoacetoxyethyl methacrylate;
(III-9) Copolymer of methyl acrylate, sodium acryloxypropanesulfonate and 2-acetoacetoxyethyl methacrylate;
(III-10) Copolymer of butyl acrylate and vinylidene chloride.

The polymer latex is used in an amount of 10–500 wt % of the high-boiling point organic solvent used in preparing an emulsified dispersion of an oil-soluble brightener, with the range of 30–300 wt % being preferred.

The principal advantage of the present invention is attained by preliminarily mixing the emulsified dispersion of an oil-soluble brightener with the polymer latex, then incorporating the mixture in a selected photographic constituent layer. The mixing of the emulsified dispersion and the polymer latex is preferably effected within 24 hours, more preferably within 8 hours, from the time when the formation of an emulsified dispersion of an oil-soluble brightener is completed. The mixture of the emulsified dispersion of an oil-soluble brightener and the polymer latex is to be incorporated in the same layer as the one already described in connection with the incorporation of said emulsified dispersion.

Photographic light-sensitive emulsions to be used in the present invention may be prepared by techniques known in the photographic art. A particularly preferred one is the silver halide photographic emulsion prepared by the following procedures: silver halide grains containing at least silver chloride are formed under conditions that are substantially free from a silver halide solvent to these grains, an aqueous solution containing both a silver halide solvent and a water-soluble bromide and/or iodide is added so as to effect halide conversion on the silver halide composition of the grains, and finally a water-soluble iridium salt is added in an amount of $10^{-8}$ to $10^{-5}$ moles per mole of silver halide.

In the above-described process for preparing a silver halide emulsion by halide conversion, grains made of a silver halide having relatively low solubility, such as silver chloride or silver bromide, are first formed; then, a solution of a water-soluble halide such as bromide or iodide that forms a silver halide having an even lower solubility is added to replace part or all of the halide ions in the previously formed silver halide grains with later added halide ions, thereby producing an emulsion composed of silver halide grains having a different composition than the initially formed grains. The so prepared emulsion is called a "halide converted" silver halide photographic emulsion.

The silver halide grains to be subjected to halide conversion contain at least silver chloride in their composition and are typically made of silver chloride, silver chlorobromide, silver chloroiodide or silver chloroiodobromide. In order to provide enhanced resistance to pressure, the silver halide grains prior to halide conversion desirably contain 30–70 mol % of silver bromide.

The halide composition of the silver halide grains to be obtained at the time of completion of emulsion preparation may be freely selected according to the specific use of the photographic emulsion to be finally produced. In order to prepare a high-speed and low-fog emulsion, the final halide composition desirably contains at least 80 mol % of silver bromide. In order to obtain an emulsion capable of efficient development, the content of silver iodide is desirably reduced to 3 mol % and below.

The temperature for emulsion production may be selected from a broad range but in order to produce a low-fog emulsion, the temperature is desirably held at 50° C. and below both during and after halide conversion.

The size of silver halide grains to be obtained at the time when the production of an emulsion is completed can be controlled by such factors as the size of silver halide grains before halide conversion, the conditions (e.g., time and temperature) for addition of an aqueous solution of a water-soluble halide containing a silver halide solvent, the type and quantity of the silver halide solvent in said aqueous solution, as well as the time of Ostwald ripening effected after addition of said aqueous solution, and the temperature for that ripening. While the size of silver halide grains to be obtained upon completion of emulsion production can be selected from a broad range depending upon the desired performance of the emulsion to be finally obtained, it is preferably set at a value at least twice the average size of silver halide grains just prior to halide conversion in order to produce an emulsion capable of efficient development.

The silver halide solvent for use in halide conversion may be selected from among various known compounds having the ability to dissolve silver halide, such as ammonia, thiocyanates and thioether, with ammonia being particularly preferred. The silver halide solvent is desirably used in an amount of at least 0.1 mole per mole of silver halide, it being particularly desirable to use at least 1 mole of the silver halide solvent if the latter is ammonia.

The silver halide grains to be subjected to halide conversion can be formed by a variety of known mixing methods, such as the single-jet method in which a silver salt solution is injected into a halide solution with stirring, the reverse mixing method in which a halide solution is injected into a silver salt solution, the double-jet method in which a silver salt solution and a halide solution are injected simultaneously, and combinations of these methods. In such cases where a monodisperse emulsion is required, the double-jet mixing method is preferably performed with the pAg of the mixed solution being controlled.

A variety of water-soluble iridium salts may be employed in the present invention and typical examples of useful compounds are potassium and ammonium salts of iridium chloride.

The water-soluble iridium compound to be incorporated in a silver halide emulsion is preferably used in an amount of $10^{-8}$ to $10^{-5}$ moles, more preferably $10^{-7}$ to $10^{-6}$ moles, per mole of silver halide.

The water-soluble iridium salt is preferably added after the addition of a silver halide solvent is started but not later than the completion of Ostwald ripening.

The developing agent to be incorporated in the silver halide photographic paper produced by the process of the present invention may be selected according to the specific nature of the photographic paper finally prepared. Typical examples of HO—(CH=CH)$_n$—OH type developing agents include: hydroquinone, catechol, pyrogallol, derivatives thereof, ascorbic acid, chlorohydroquinone, bromohydroquinone, isopropyl hydroquinone, toluhydroquinone, methyl hydroquinone, 2,3-dichlorohydroquinone, 2,5-dimethylhydroquinone, and 2,3-dibromohydroquinone.

Typical examples of HO—(CH=CH)$_n$—NH$_2$ type developing agents are ortho- and para-aminophenols and aminopyrazolones such as 4-aminophenol, 2-amino-6-phenylphenol, 2-amino-4-chloro-6-phenylphenol, and 4-amino-2-phenylphenol.

Specific examples of H$_2$N—(CH=CH)$_n$—NH$_2$ type developing agents include 4-amino-2-methyl-N,N-diethylaniline, 2,4-diamino-N,N-diethylaniline, N-(4-amino-3-methylphenyl)-morpholine, P-phenylenediamine, and 4-amino-N,N-dimethyl-3-hydroxyaniline.

Exemplary hetero-ring type developing agents include: 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone, and 1-phenyl-4-methyl-4-hydroxymethyl-3-pyrazolidone; and 1-phenyl-4-amino-5-pyrazolone, 1-(p-amino-phenyl)-3-amino-2-pyrazoline, 1-phenyl-3-methyl-4-amino-5-pyrazolone, and 5-aminouracil.

Other developing agents that can effectively be used in the present invention are described in such references as T. H. James, "The Theory of the Photographic Process", Fourth Edition, Macmillan Publishing Co., Inc., pp. 291–334, and Journal of the American Chemical Society, vol. 73, p. 3,100, 1951. These and the above-mentioned developing agents may be used either alone or in combination. Preferably, they are used in combination.

In the present invention, a 1-phenyl-3-pyrazolidone represented by the following general formula (IV) is preferably incorporated in a silver halide photographic paper:

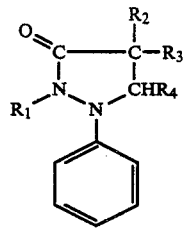

(IV)

where $R_1$ is a hydrogen atom or an acetyl group; $R_2$, $R_3$ and $R_4$ are each a hydrogen atom or a substituted or unsubstituted alkyl group.

Typical examples of the 1-phenyl-3-pyrazolidone represented by the general formula (IV) are listed below under (A-1) to (A-8). Needless to say, these are not the sole examples of the 1-phenyl-3-pyrazolidone compounds that can be used in the present invention:

(A-1) 1-phenyl-3-pyrazolidone;
(A-2) 1-phenyl-4-methyl-3-pyrazolidone;
(A-3) 1-phenyl-4,4-dimethyl-3-pyrazolidone;
(A-4) 1-phenyl-5-methyl-3-pyrazolidone;
(A-5) 1-phenyl-4-methyl-4-hydroxymethyl-3-pyrazolidone;
(A-6) 1-phenyl-4,4-dihydroxymethyl-3-pyrazolidone;
(A-7) 1-phenyl-4,4-di-n-propyl-3-pyrazolidone;
(A-8) 1-phenyl-2-acetyl-4,4-dimethyl-3-pyrazolidone.

These 1-phenyl-3-pyrazolidones are desirably used in amounts ranging from 0.2 to 5 g per mole of silver halide.

The 1-phenyl-3-pyrazolidones may be incorporated in any of the photographic constituent layers that are disposed on the side where silver halide emulsion layers are provided, it being effective to incorporate the 1-phenyl-3-pyrazolidones in silver halide emulsion layers.

In the process of the present invention for producing a silver halide photographic paper, gelatin is usually employed as a binder or a protective colloid. Besides gelatin, other materials may be employed, which include: proteins such as gelatin derivatives, graft polymers of gelatin and other high-molecular weight substances, albumin and casein; cellulose derivatives such as hydroxyethyl cellulose and carboxymethyl cellulose; saccharide derivatives such as agar, sodium alginate and starch derivatives; and a variety of synthetic hydrophilic high-molecular weight substances such as homopolymers and copolymers exemplified by polyvinyl alcohol, poly-N-vinylpyrrolidone, polyacrylic acid, polyacrylamide, polyvinyl imidazole, and polyvinyl pyrazole.

The silver halide photographic emulsion to be used in the present invention may be chemically sensitized with various sensitizers, such as sulfur sensitizers (e.g. hypo, thiourea, and activated gelatin), noble metal sensitizers (e.g. gold chloride, gold rhodanide, platinum salt, palladium salt, rhodium salt and ruthenium salt), reducing sensitizers (e.g. stannous chloride, thiourea dioxide, and hydrazine derivatives), the selenium sensitizers described in U.S. Pat. No. 3,297,446, and the polyalkylene polyamine compounds described in U.S. Pat. No.

2,518,698. These chemical sensitizers may be used either on their own or as admixtures. The silver halide photographic emulsion may incorporate various known photographic addenda such as optical sensitizers, stabilizers, anti-foggants, hardeners, surfactants and color couplers.

The so prepared photographic emulsion may be coated on baryta paper, resin-coated paper or some other suitable supports to produce silver halide photographic paper.

As the developing agents contained in the developing solution to be used in developing the silver halide photographic paper produced by the process of the present invention, those which are to be incorporated in the photographic paper as mentioned above may likewise be use.

The said developing solution may incorporate as a preservative a sulfite such as sodium sulfite or potassium sulfite without impairing the advantage of the present invention. Other preservatives that may be employed are hydroxylamine and hydrazide compounds. If desired, caustic alkalis, alkali carbonates or amines may be employed to achieve both pH adjustment and buffer action as with ordinary black-and-white developing solutions. Another optional practice is to incorporate one or more of the following additives: inorganic development restrainers such as potassium bromide; organic development restrainers such as benzotriazole; metal ion sequestrants such as ethylenediaminetetraacetic acid; development accelerators such as methanol, ethanol, benzyl alcohol and polyalkylene oxides; surfactants such as sodium alkylarylsulfonates, natural saponin, saccharides, and alkyl esters of these compounds; hardeners such as glutaraldehyde, formalin and glyoxal; and ionic strength modifiers such as sodium sulfate.

The developing solution used to develop the photographic paper that is prepared by the present invention may also contain an alkanolamine or glycol as an organic solvent.

The developing solution having the composition described above typically ranges from 9 to 12 in pH but from the viewpoints of stability and photographic characteristics, the range of 10–11 is preferred.

The silver halide photographic paper produced by the process of the present invention can be processed under various conditions. For example, the temperature for development is preferably not more than 50° C., with the range of 30°–40° C. being particularly preferred. The development time generally is not more than 3 minutes and good results are often attained if development is completed within a period of one minute. It is optional to include processing steps other than development such as washing, stopping, stabilization, fixing, and even prehardening and neutralization. Of course, these steps may be omitted as appropriate. Development may be performed either manually as by tray development or frame development, or mechanically as by roller development or hanger development.

The following examples are provided for the purpose of further illustrating the present invention but, needless to say, they are not to be taken as limiting.

EXAMPLE 1

Octahedral silver halide emulsion were prepared; their silver halide composition consisted of 90 mol % AgBr, 9 mol % AgCl and 1 mol % AgI, and their average grain size was 0.6 μm.

To the emulsion, a compound having the structural formula (X) noted below was added as a sensitizing dye in an amount of 150 mg per mole of silver (Ag). After performing gold sensitization and sulfur sensitization, a sensitizing dye of the structural formula (Y) given below was added in an amount of 100 mg/mol Ag. Thereafter, 4-hydroxy-6-methyl-1,3,3*a*, 7-tetrazaindene (stabilizer), 1-phenyl-5-mercaptotetrazole (fog restrainer) and sodium tripropylnaphthalenesulfonate (coating aid) were added in amounts of 1 g/mol Ag, 60 mg/mol Ag and 1 g/mol Ag, respectively. Subsequently, a mixture of a polymer latex and an emulsified dispersion of a fluorescent brightener was prepared by the method to be described below, and added to the emulsion base. Also added were 20 g/mol Ag of diethylene glycol as a film property improving agent, 5 g/mol Ag of a styrene-maleic anhydride copolymer as a thickening agent, and 20 mg (per gram of gelatin) of the reaction product of tetraquis(vinylsulfonylmethyl)methane and potassium salt of taurine at a molar ratio of 1:0.25 as a hardener. The resulting mixture was adjusted to a pH of 5.5 with citric acid to prepare a coating solution for emulsion layer.

Comparative coating solutions for emulsion layer were prepared by separately adding an emulsified dispersion of a brightener and a polymer latex.

Preparation of a mixture of emulsified dispersion of brightener and polymer latex:

One gram of compound (II-4) or (II-13) as an oil-soluble brightener, 20 g of compound (I-2) or (I-7) as a high-boiling point organic solvent, and 20 ml of n-butanol as a low-boiling point organic solvent were mixed to form a solution. The solution was added to 250 ml of a 12% aqueous gelatin solution containing 0.5 g of sodium tripropylnaphthalenesulfonate, and the mixture was emulsified with an ultrasonic disperser at about 60° C. The resulting emulsified dispersion was cooled to 40° C. Thereafter, 40 ml of a polymer latex solution containing compound (III-1) or (III-4) at a solids content of 50% was added to the cooled emulsified dispersion so as to prepare a mixture of the emulsified brightener and the polymer latex.

Different mixtures were prepared by changing the interval between the completion of emulsification and the mixing with the polymer latex from one hour to eight hours through 24 hours to 36 hours.

Sensitizing dye X

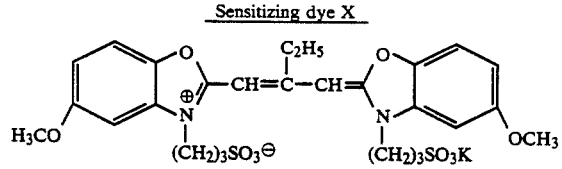

Sensitizing dye Y

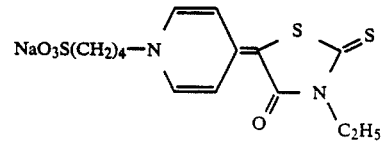

In the next step, a gelatin binder was mixed with 30 mg/m² of silica (average particle size, 4 μm) as a matting agent, 30 mg/m² of a sodium salt of 2-sulfonate succinic acid bis(2-ethylhexyl)ester as a coating aid, 20 mg/m² of a compound of formula (A) to be noted below as a fluorine-containing surfactant, 100 mg/m² of a styrene-maleic anhydride copolymer as a thickening agent, and 20 mg per gram of gelatin of formalin as a hardener. After further adding 1.2 mg/m² of 1-phenyl-5-mercaptotetrazole, the mixture was adjusted to a pH of 5.5 with citric acid so as to prepare a coating solution for protective layer.

The so prepared coating solutions for emulsion layer and protective layer were coated in superposition on the subbed surface of polyethylene-coated paper having a thickness of 110 μm. The support had a hydrophilic colloidal backing layer on the side opposite the side where at least one silver halide emulsion layer was to be formed. Immediately before the coating operation (within 10 seconds), a mixed solution of hydroquinone (15 g/mol Ag), 1-phenyl-3-pyrazolidone (1 g/mol Ag) and compound (B) indicated below (4 g/mol Ag) was added to the coating solution for emulsion layer. Comparative samples were also prepared without incorporating any developing agent.

The silver deposit was 1.4 g/m², and the gelatin deposit was 2.0 g/m² for the emulsion layer and 1.7 g/m² for the protective layer.

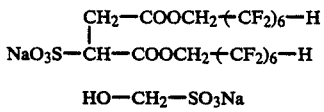

(A)

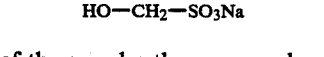

(B)

Each of the samples thus prepared was divided into two portions, one of which was stored for 1 week at 50° C. and at a relative humidity of 40% while the other portion was stored for 1 week at ambient temperature and humidity. All of the unexposed samples were developed with a developer (for its composition, see below) at 38° C. for 15 seconds, subsequently fixed, washed and dried by an automatic processor GR-26 (product of Konica Corporation).

| Developer: | |
|---|---|
| Pure water (ion-exchanged water) | ca. 800 ml |
| Potassium sulfite | 60 g |
| Ethylenediaminetetraacetic acid disodium salt | 2 g |
| Potassium hydride | 10.5 g |
| 5-Methylbenzotriazole | 300 ml |
| Diethylene glycol | 25 g |
| 1-Phenyl-4,4-dimethyl-3-pyrazolidinone | 300 ml |

-continued

| | |
|---|---|
| 1-Phenyl-5-mercaptotetrazole | 60 ml |
| Potassium bromide | 3.5 g |
| Hydroquinone | 20 g |
| Potassium carbonate | 15 g |
| Pure water (ion-exchanged water) to make | 1,000 ml |
| pH adjusted to about | 10.8 |

| Fixing solution: | |
|---|---|
| (Composition A) | |
| Ammonium thiosulfate (aqueous solution of 72.5% w/v) | 240 ml |
| Sodium sulfite | 17 g |
| Sodium acetate trihydrate | 6.5 g |
| Boric acid | 6 g |
| Sodium citrate dihydrate | 2 g |
| Acetic acid (aqueous solution of 90% w/w) | 13.6 ml |
| (Composition B) | |
| Pure water (ion-exchanged water) | 17 ml |
| Sulfuric acid (aqueous solution of 50% w/w) | 4.7 g |
| Aluminum sulfate (aqueous solution of 8.1% w/w calculated in terms of $Al_2O_3$) | 26.5 g |

At the time of using the fixing solution, the above-mentioned composition were dissolved in 500 ml of pure water in order of A and B to make 1,000 ml of fixing solution, the pH of which was about 4.3.

The processed samples were then evaluated for the intensity of fluorescence by the following method. The reflection density of each of the processed samples was measured with a color analyzer (Model 607 of Hitachi, Ltd.) under illumination with a xenon lamp, and the intensity of fluorescence was estimated in terms of relative values of a decrease in reflection density at 440 nm due to the addition of a brightener.

The results are shown in Table 1, from which one can see that the samples prepared in accordance with the present invention by incorporating preliminarily mixed emulsified dispersions of oil-soluble brighteners and polymer latices experienced a smaller decrease in the intensity of fluorescence even after storage for 7 days at 50° C. and at 50% r.h. Therefore, these samples retained a high level of whiteness in spite of incorporation of developing agents.

TABLE 1

| Sample No. | Developing agent | High-boiling point solvent | Brightener | Polymer latex | Time to mixing | Relative intensity of fluorescence: 7 days at ambient temperature and humidity | Relative intensity of fluorescence: 7 days at 50° C. and 40% r.h. | Remarks |
|---|---|---|---|---|---|---|---|---|
| 1 | incorporated | I-2 | II-4 | III-4 | 1 h | 80 | 72 | the invention |
| 2 | " | I-2 | II-4 | III-4 | 8 h | 80 | 70 | " |
| 3 | " | I-2 | II-4 | III-4 | 24 h | 80 | 66 | " |
| 4 | " | I-2 | II-4 | III-4 | 36 h | 76 | 48 | " |
| 5 | " | I-2 | II-4 | III-4 | added separately | 74 | 36 | comparison |
| 6 | " | I-7 | II-13 | III-1 | 1 h | 100 | 92 | the invention |
| 7 | " | I-7 | II-13 | III-1 | 8 h | 100 | 90 | " |
| 8 | " | I-7 | II-13 | III-1 | 24 h | 100 | 84 | " |
| 9 | " | I-7 | II-13 | III-1 | 36 h | 96 | 60 | " |
| 10 | " | I-7 | II-13 | III-1 | added separately | 94 | 48 | comparison |
| 11 | absent | I-7 | II-13 | III-1 | 1 h | 100 | 90 | " |
| 12 | " | I-7 | II-13 | III-1 | 8 h | 100 | 90 | " |
| 13 | " | I-7 | II-13 | III-1 | 24 h | 100 | 88 | " |
| 14 | " | I-7 | II-13 | III-1 | 36 h | 96 | 84 | " |
| 15 | " | I-7 | II-13 | III-1 | added separately | 94 | 80 | " |

EXAMPLE 2

As silver halide emulsions, the following emulsion A to I were prepared.

| Emulsion A | |
|---|---|
| Solution I | |
| Gelatin | 20 g |
| Water | 400 ml |
| Solution II | |
| $AgNO_3$ | 60 g |
| Water | 250 ml |
| Solution III | |
| NaCl | 18 g |
| KBr | 21 g |
| Water | 150 ml |
| Solution IV | |
| KBr | 22 g |
| KI | 0.6 g |
| Water | 200 ml |
| Aqueous ammonia (28%) | 40 ml |
| Solution V | |
| 0.5% $K_2[Ir(IV)Cl_6]$ | 0.75 ml |
| Water | 36.75 ml |

Solutions II and III were simultaneously injected into solution I over a period of 5 minutes. Following 10-min ripening, solution IV was injected over one minute. One minute after completion of the injection of solution IV, a 0.25 ml portion was sampled from solution V and added to the mixture. After ripening was conducted for 18 minutes following the addition of solution V, 180 ml of acetic acid (20%) was added so as to prepare emulsion A. Throughout these operations, the solutions were held at 40° C. Emulsion A had an average grain size of 0.6 μm, with the standard deviation of particle size distribution being 0.1 μm. The AgBr content just prior to the halide conversion was 50 mol % and the average grain size was 0.15 μm.

Emulsion B

This emulsion was prepared in entirely the same manner as in the case of emulsion A except that solution V was not added.

Emulsion C

This emulsion was prepared in the same manner as in the case of emulsion A except that solution V had been mixed with aqueous gelatin solution I before injection of solutions II and III. Solution V was added in an amount of 0.25 ml as in the preparation of Emulsion A.

Emulsion D

This emulsion was prepared by the same procedures as in the case of Emulsion A except that 0.25 ml of solution V was preliminarily mixed with solution III.

Emulsion E

This emulsion was prepared by the same method as in the case of Emulsion A except that 0.25 ml of solution V was added one minute before injecting solution IV.

Emulsion F

This emulsion was prepared in the same manner as in the case of Emulsion A except that 0.25 ml of solution V was added 5 minutes before injecting acetic acid (20%).

Emulsion G

Solutions I–III and solution VI having the composition shown below were provided. Solution VI was identical to solution IV except that it did not contain silver halide solvent ammonia:

| Solution VI | |
|---|---|
| KBr | 22 g |
| KI | 0.6 g |
| Water | 240 ml |

Solutions II and III were simultaneously injected into solution I over a period of 60 minutes. Following 5-min ripening, solution VI was injected over a period of 1 minute. By performing ripening for an additional 30 minutes, emulsion G was prepared. Throughout these operations, the solutions were all held at 65° C. Emulsion G had an average grain size of 0.6 μm, with the standard deviation of particle size distribution being 0.1 μm. The average grain size just prior to the halide conversion was 0.5 μm.

Emulsion H

Solutions I and II, and solution VII having the composition indicated below were provided.

| Solution VII | |
|---|---|
| NaCl | 18 g |
| KBr | 43 g |
| KI | 0.6 g |
| Water | 390 ml |

Solutions II and VII were simultaneously injected into solution I over a period of 180 minutes so as to prepare Emulsion H. Throughout the injecting operation, the solutions were held at 65° C. This emulsion had an average grain size of 0.6 μm, with the standard deviation of grain size distribution being 0.1 μm.

Emulsion I

Solution I and solutions VIII and IX having the compositions indicated below were prepared:

| Solution VIII | |
|---|---|
| $AgNO_3$ | 60 g |
| Water | 240 ml |
| Aqueous ammonia (28%) | 40 ml |
| **Solution IX** | |
| NaCl | 18 g |
| KBr | 43 g |
| KI | 0.6 g |
| Water | 350 ml |

Solutions VIII and IX were injected into solution I over a period of one minute. Following 40-min ripening, 180 ml of acetic acid (20%) was added to make Emulsion I. Throughout these operations, the solutions were all held at 40° C. Emulsion I had an average grain size of 0.6 μm, with the standard deviation of grain size distribution being 0.1 μm.

Samples Nos. 1 to 15 were prepared in the same manner as in Example 1 except for using the above-mentioned emulsions A to I. Provided that hydroquinone was not added and that the conditions for mixing an emulsified dispersion of brightener and a polymer latex are as shown in Table 2.

All the samples thus prepared were evaluated for the intensity of fluorescence in the same manner as in Example 1.

Also, the samples were subjected to exposure for $10^{-6}$ second with a xenon flash through an optical wedge and thereafter developed as in Example 1. Provided that the developing conditions were varied in time to 20, 30 and 40 seconds at 38° C. with a view to evaluating the developability.

After processing, the samples were measured for transmission density with a Sakura desital densitometer PDA-65 (product of Konica Corporation) and then evaluated for photographic characteristics by drawing a characteristic curve. The results are shown in Table 2.

In Table 2, the sensitivity is indicated with a relative value in the reciprocal of the amount of exposure necessary for obtaining a photographic density of 3.0. The γ-value indicates a slope of the strait line portion of the characteristic curve and the greater the γ-value, the higher the contrast is. $D_{max}$ indicates the maximum density of the samples after processing, and $D_{min}$ indicates the density of the unexposed portion.

Next, the samples were evaluated for pressure resistance in such a manner that a sapphire needle having a forward spherical end applied with a load was moved on the emulsion surface of each sample in dried stat before development, the sample being then developed in the same manner as above without exposure to light. Provided that the time of development was set at only 30 seconds. Subsequently, evaluation was performed in ten stages, that is, 1 to 10, the samples of which fog was not observed at the time of applying pressure being rated as 10 and those of which fog was observed much under pressure being rated as 1. Samples rated as 6 or more are practically usable.

TABLE 2

| Sample No. | Emulsion | High-boiling point solvent | Brightener | Polymer latex | Time to mixing | Relative intensity of fluorescence: 7 days at ambient temperature and humidity | Relative intensity of fluorescence: 7 days at 50° C. and 40% r.h. | Remarks |
|---|---|---|---|---|---|---|---|---|
| 1 | A | I-2 | II-4 | III-4 | 1 h | 80 | 73 | the invention |
| 2 | A | I-2 | II-4 | III-4 | added separately | 73 | 35 | comparison |
| 3 | A | I-7 | II-13 | III-1 | 1 h | 100 | 94 | the invention |
| 4 | A | I-7 | II-13 | III-1 | 8 h | 100 | 93 | " |
| 5 | A | I-7 | II-13 | III-1 | 24 h | 100 | 87 | " |
| 6 | A | I-7 | II-13 | III-1 | 36 h | 97 | 65 | " |
| 7 | A | I-7 | II-13 | III-1 | added separately | 94 | 43 | comparison |
| 8 | B | I-7 | II-13 | III-1 | 1 h | 100 | 95 | the invention |
| 9 | C | I-7 | II-13 | III-1 | 1 h | 100 | 94 | " |
| 10 | D | I-7 | II-13 | III-1 | 1 h | 99 | 94 | " |
| 11 | E | I-7 | II-13 | III-1 | 1 h | 100 | 95 | " |
| 12 | F | I-7 | II-13 | III-1 | 1 h | 101 | 95 | " |
| 13 | G | I-7 | II-13 | III-1 | 1 h | 100 | 95 | " |
| 14 | H | I-7 | II-13 | III-1 | 1 h | 100 | 94 | " |
| 15 | I | I-7 | II-13 | III-1 | 1 h | 100 | 94 | " |

TABLE 2

| Sample No. | Developing time | Sensitivity | γ | Dmax | Dmin | Pressure resistance | Remarks |
|---|---|---|---|---|---|---|---|
| 1 | 30" | 98 | 2.09 | 1.45 | 0.02 | 10 | the invention |
| 2 | 30" | 95 | 2.10 | 1.43 | 0.02 | 10 | comparison |
| | 20" | 86 | 1.80 | 1.35 | 0.02 | | |
| 3 | 30" | 100 | 2.11 | 1.49 | 0.02 | 10 | the invention |
| | 40" | 113 | 2.15 | 1.52 | 0.02 | | |
| 4 | 30" | 102 | 2.09 | 1.45 | 0.02 | 10 | " |
| 5 | 30" | 98 | 2.11 | 1.46 | 0.02 | 10 | " |
| 6 | 30" | 100 | 2.10 | 1.45 | 0.02 | 10 | " |
| 7 | 30" | 99 | 2.10 | 1.47 | 0.02 | 10 | comparison |
| | 20" | 70 | 1.44 | 1.35 | 0.02 | | |
| 8 | 30" | 85 | 1.80 | 1.45 | 0.02 | 8 | the invention |
| | 40" | 90 | 1.89 | 1.48 | 0.03 | | |
| | 20" | 83 | 1.77 | 1.37 | 0.02 | | |
| 9 | 30" | 96 | 2.09 | 1.45 | 0.02 | 9 | " |
| | 40" | 107 | 2.14 | 1.50 | 0.02 | | |
| | 20" | 83 | 1.80 | 1.36 | 0.02 | | |
| 10 | 30" | 96 | 2.10 | 1.46 | 0.02 | 9 | " |
| | 40" | 110 | 2.17 | 1.53 | 0.02 | | |
| | 20" | 82 | 1.77 | 1.37 | 0.02 | | |
| 11 | 30" | 97 | 2.08 | 1.45 | 0.02 | 9 | " |
| | 40" | 109 | 2.12 | 1.52 | 0.02 | | |
| | 20" | 88 | 1.75 | 1.27 | 0.02 | | |
| 12 | 30" | 101 | 2.07 | 1.39 | 0.02 | 10 | " |
| | 40" | 114 | 2.13 | 1.45 | 0.02 | | |
| | 20" | 63 | 1.32 | 1.02 | 0.02 | | |
| 13 | 30" | 90 | 1.86 | 1.20 | 0.02 | 8 | " |
| | 40" | 115 | 1.90 | 1.31 | 0.03 | | |
| | 20" | 43 | 1.15 | 0.99 | 0.02 | | |
| 14 | 30" | 74 | 1.54 | 1.20 | 0.02 | 7 | " |
| | 40" | 111 | 1.63 | 1.28 | 0.02 | | |
| | 20" | 86 | 1.80 | 1.32 | 0.02 | | |
| 15 | 30" | 98 | 2.05 | 1.47 | 0.02 | 6 | " |
| | 40" | 116 | 2.09 | 1.52 | 0.02 | | |

As is clear from Table 2, among the samples of the present invention, those using Emulsion A or F prepared by the halide conversion process disclosed in the present invention are superior in pressure resitance, developability and photographic performance as compared with the samples using Emulsion B, G, H or I which were not prepared by the above halide conversion process.

Also, the samples using said Emulsion A or F differ little from the samples using Emulsion C, D or E in developability and photographic performance, but are superior in pressure resistance.

The present invention provides a process for producing a silver halide photographic paper that ensures a high level of whiteness even if it is processed rapidly, and which experiences a small amount of deterioration in whiteness with time.

The present invention also provides a process for producing a silver halide photographic paper that has improved photographic performance in such aspects as speed and contract, and which also features high pressure resistance, good developability, and long keeping quality.

What is claimed is:

1. A process for producing a silver halide photographic paper having, on a support, at least one photographic constituent layer incorporating a silver halide developing agent, and at least one photographic constituent layer containing both a polymer latex and an emulsified dispersion of an oil-soluble fluorescent brightener dissolved in a high-boiling point organic solvent which comprises preliminarily mixing said emulsified dispersion with said polymer latex, and then incorporating the resulting mixture in a selected photographic constituent layer.

2. A process according to claim 1 wherein the mixing of said emulsified dispersion with said polymer latex is effected within 24 hours after preparing said emulsified dispersion.

3. A process according to claim 2 wherein the mixing of said emulsified dispersion with said polymer latex is effected within 8 hours after preparing said emulsified dispersion.

4. A process according to claim 1 wherein said oil-soluble fluorescent brightener is at least one of the compounds represented by the following general formulas (II-a) to (II-d):

[II-a]

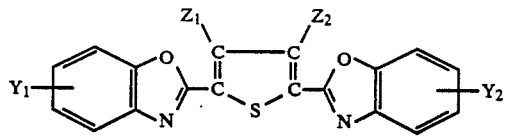

[II-b]

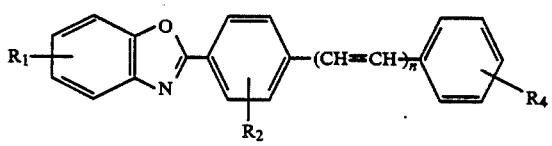

[II-c]

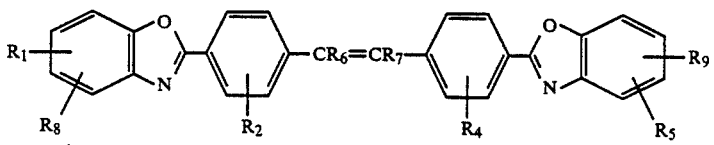

[II-d]

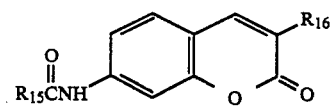

where $Y_1$ and $Y_2$ are each an alkyl group; $Z_1$ and $Z_2$ are each a hydrogen atom or an alkyl group; n is 1 or 2; $R_1$, $R_2$, $R_4$, $R_5$, $R_8$ and $R_9$ are each an aryl, alkyl, alkoxy, aryloxy, hydroxyl, amino, cyano, carboxyl, amido, ester, alkylcarbonyl, alkylsulfo or dialkylsulfonyl group or a hydrogen atom; $R_6$ and $R_7$ are each a hydrogen atom, an alkyl group or a cyano group; $R_{16}$ is a phenyl group, a halogen atom, or an alkyl substituted phenyl group; and $R_{15}$ is an amino group or an organic primary or secondary amine.

5. A process according to claim 1 wherein said oil-soluble fluorescent brightener is incorporated in an amount of 1–200 mg/m$^2$ in the photographic paper.

6. A process according to claim 5 wherein said oil-soluble fluorescent brightener is incorporated in an amount of 5–50 mg/m$^2$ in the photographic paper.

7. A process according to claim 1 wherein the mixture of said emulsified dispersion and said polymer latex is incorporated in a silver halide emulsion layer.

8. A process according to claim 1 wherein said polymer latex is a homo- or copolymer having at least one alkyl acrylate unit in the building block.

9. A process according to claim 1 wherein said polymer latex is incorporated in an amount of 10–500 wt % of said high-boiling point organic solvent.

10. a process according to claim 9 wherein said polymer latex is incorporated in an amount of 30–300 wt % of said high-boiling point organic solvent.

11. A process according to claim 1 wherein said high-boiling point organic solvent is a phosphate ester.

12. A process according to claim 1 wherein said silver halide developing agent is a hetero-ring type developing agent.

13. A process according to claim 12 wherein said silver halide developing agent is at least one compound represented by the following general formula (IV):

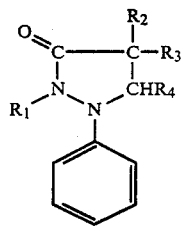

(IV)

where $R_1$ is a hydrogen atom or an acetyl group; $R_2$, $R_3$ and $R_4$ are each a hydrogen atom or a substituted or unsubstituted alkyl group.

14. A process according to claim 1 wherein said silver halide developing agent is incorporated in a photographic constituent layer in an amount ranging from 0.2 to 5 g per mole of silver halide.

15. A process according to claim 1 wherein said photographic paper contains a silver halide emulsion prepared by the following steps: forming silver halide grains containing at least silver chloride under conditions that are substantially free from a silver halide solvent; adding to these grains an aqueous solution containing both a silver halide solvent and a water-soluble bromide and/or iodide so as to effect halide conversion on the silver halide composition of said grains; and finally adding a water-soluble iridium salt in an amount of $10^{-8}$ to $10^{-5}$ moles per mole of silver halide.

16. A process according to claim 15 wherein said silver halide emulsion contains at least 80 mol % silver bromide.

17. A process according to claim 16 wherein said silver halide emulsion contains $10^{-7}$ to $10^{-6}$ moles of the water-soluble iridium salt per mole of silver halide.

* * * * *